US007717515B2

(12) United States Patent
Saez et al.

(10) Patent No.: US 7,717,515 B2
(45) Date of Patent: May 18, 2010

(54) CHAIR HAVING AN AUTOMATICALLY ADJUSTING RESISTANCE TO TILTING

(75) Inventors: Manuel Saez, Brooklyn, NY (US); Lachezar Tsvetanov, Stamford, CT (US)

(73) Assignee: Humanscale Corporation, New York, NY (US)

( * ) Notice: Subject to any disclaimer, the term of this patent is extended or adjusted under 35 U.S.C. 154(b) by 429 days.

(21) Appl. No.: 11/739,505

(22) Filed: Apr. 24, 2007

(65) Prior Publication Data

US 2007/0246984 A1 Oct. 25, 2007

Related U.S. Application Data

(60) Provisional application No. 60/745,434, filed on Apr. 24, 2006.

(51) Int. Cl.
*A47C 3/026* (2006.01)
*A47C 1/024* (2006.01)
*A47C 1/032* (2006.01)

(52) U.S. Cl. ..... 297/316; 297/303.1

(58) Field of Classification Search ..... 297/303.1, 297/316

See application file for complete search history.

(56) References Cited

U.S. PATENT DOCUMENTS 2,991,125 A 7/1961 Lie
4,411,469 A 10/1983 Drabert et al.
4,640,548 A 2/1987 Desanta
4,709,962 A * 12/1987 Steinmann ..... 297/316 X
4,761,033 A * 8/1988 Lanuzzi et al. ..... 297/316 X
4,765,679 A * 8/1988 Lanuzzi et al. ..... 297/316 X
4,773,706 A * 9/1988 Hinrichs ..... 297/316 X
4,830,430 A 5/1989 Schafer
4,966,411 A * 10/1990 Katagiri et al. ..... 297/300.7
5,195,801 A * 3/1993 Franck et al. ..... 297/300.5
5,308,144 A * 5/1994 Korn ..... 297/300.2
5,401,077 A * 3/1995 Hosoe ..... 297/316 X
5,660,439 A * 8/1997 Unwalla ..... 297/316
5,775,774 A 7/1998 Okano
5,810,440 A * 9/1998 Unwalla ..... 297/316
5,826,940 A 10/1998 Hodgdon
5,931,531 A * 8/1999 Assmann ..... 297/316
5,964,503 A * 10/1999 Inoue ..... 297/300.4
6,000,755 A * 12/1999 Uhlenbrock ..... 297/316 X
6,109,694 A * 8/2000 Kurtz ..... 297/320
6,234,573 B1 * 5/2001 Roder et al. ..... 297/300.5
6,523,896 B1 * 2/2003 Uhlenbrock ..... 297/301.3 X (Continued)

OTHER PUBLICATIONS

The International Search Report and Written Opinion of the International Searching Authority by the International Searching Authority-US for PCT Application PCT/US07/67316 on Dec. 28, 2007.

(Continued)

*Primary Examiner*—Rodney B White
(74) *Attorney, Agent, or Firm*—Jones, Walker, Waechter, Poitevent, Carrere & Denegre, L.L.P.

(57) ABSTRACT

A chair having an automatically adjusting resistance to tilt. The chair includes a back support, a frame, a base and a back pivot member, which is pivotally mounted to the frame, and a seat, which is also pivotally mounted to the frame, such that an occupant of the chair adjusts resistance to tilt or reclining of the chair by applying a rearward force to the back support.

5 Claims, 14 Drawing Sheets

U.S. PATENT DOCUMENTS

| | | | | |
|---|---|---|---|---|
| 6,692,075 | B2 * | 2/2004 | Sander et al. | 297/316 |
| 6,709,057 | B2 * | 3/2004 | Sander et al. | 297/316 |
| 6,709,058 | B1 * | 3/2004 | Diffrient | 297/316 X |
| 6,729,688 | B2 | 5/2004 | Erne | |
| 6,874,853 | B2 | 4/2005 | Wild | |
| 6,890,030 | B2 * | 5/2005 | Wilkerson et al. | 297/316 X |
| 6,896,329 | B2 * | 5/2005 | Sander et al. | 297/316 |
| 7,159,943 | B2 * | 1/2007 | Costaglia | 297/316 X |
| 7,566,097 | B2 * | 7/2009 | Sander et al. | 297/303.1 X |
| 2002/0167208 | A1 * | 11/2002 | Sander et al. | 297/316 |
| 2003/0184140 | A1 * | 10/2003 | Bruske | 297/316 |
| 2005/0275265 | A1 * | 12/2005 | Deimen et al. | 297/316 |
| 2006/0290182 | A1 * | 12/2006 | Moreschi | 297/316 |
| 2007/0210634 | A1 | 9/2007 | Krehm et al. | |

OTHER PUBLICATIONS

The International Preliminary Report on Patentability by the International Preliminary Examining Authority-US for PCT Application PCT/US07/67316 on Jul. 28, 2008.

* cited by examiner

CHAIR HAVING AN AUTOMATICALLY ADJUSTING RESISTANCE TO TILTING

I. CROSS-REFERENCE TO RELATED APPLICATION

This application incorporates the contents of the provisional application Ser. No. 60/745,434, filed Apr. 24, 2006, by reference in its entirety.

II. STATEMENT REGARDING FEDERALLY SPONSORED RESEARCH AND DEVELOPMENT

Not Applicable.

III. BACKGROUND OF THE INVENTION

A. Field of the Invention

The present invention generally relates to a device for supporting an occupant in a seated position, and in one preferred embodiment, to a chair of the reclining back type. In a further preferred embodiment, the present invention relates to a chair having a resistance to tilting that automatically adjusts in proportion to the weight of the user and the tilt angle.

B. Description of the Related Art

Reclining type chairs commonly used in offices typically provide for the back support to recline alone, for the seat and back support to recline as a unit, or for the back support to recline in a coordinated proportion with the seat. If the back support alone pivots, it generally creates a problem known as "shirttail pull." This problem is particularly acute if the pivot of the chair back support is not coordinated with the natural body action of the occupant. This problem can also be accentuated by the tendency of the hips of the occupant to slide forward as the back support tilts rearwardly.

In chairs where both the seat and back recline as a unit, in the reclined position there is a tendency to lift the legs of the occupant from the floor, which creates an undue pressure by the forward edge of the seat against the underside of the legs of the occupant immediately above the knee. To overcome this problem, the pivot point of the reclining action may be moved forward sufficiently to permit the occupant's feet to remain on the floor. One undesirable effect of this arrangement is that the body angle between the occupant's torso and his legs is unchanged, and as a result, the occupant's eye level drops undesirably when the chair is reclined.

In any reclining chair, it is desirable that the recline pivot point be at the center of the body or where the occupant's back normally pivots (i.e., an axis through the user's hip joints). However, the pivot point of a reclining chair is normally displaced from the ideal pivot point. It is also desirable to have a chair wherein the angle between the occupant's torso and his legs opens up to relieve internal congestive body pressures. It is further desirable to provide a chair wherein the user's feet remain on the floor and the recline action parallels the natural body action closely enough to avoid the common shirttail pull problem.

Therefore, it is also desirable to provide a chair of simple, economical construction that lends itself to high production manufacturing and fabrication procedures, and yet of clean, pleasing appearance emphasizing the isolated and separate appearance of the seat and back support with respect to the supporting frame and base.

U.S. Pat. No. 4,429,917 to Diffrient allegedly reports a chair with a four bar non-parallel linkage mechanism to obviate many of these problems. Likewise, U.S. Pat. No. 4,943,114 to Piretti allegedly reports a chair with a compact back-rest linkage mechanism that enables the chair back support and seat to recline. U.S. Pat. No. 5,251,958 to Roericht et al. allegedly reports a chair with a synchronous adjusting device that uses the weight of the user to provide a restoring force to return the chair back support to an upright position after a user has reclined in the chair. U.S. Pat. No. 5,486,035 to Koepke, et al., asserts, without providing any showing, that "[i]n such constructions, the difficulty of reclining the chair, i.e., generating the reclining force, increases the further the chair is reclined, and it is common to employ adjusting apparatus for increasing or decreasing the reclining tension of a chair, such adjusting apparatus changing the tension of a spring, or otherwise modifying the reclining mechanism" (col. 1, 11. 29-34).

Moreover, while it is believed that some reclining chairs heretofore available have had a means to adjust their resistance to reclining, such adjustments have been less than ideal, very cumbersome or not practicable to an occupant. Instead, rather than confront the processes necessary to adjust their chairs to fit the needs of their particular body build, most occupants of chairs use them without making any adjustments. Consequently, any ergonomic advantages that might be delivered by the properly tuned chair are not achieved. Thus, there remains a need for a chair that is adjustable to the needs of the individual chair occupant without requiring any substantial effort on the occupant's part to effect the adjustments—in other words, a substantially self-adjusting ergonomic chair.

IV. BRIEF DESCRIPTION OF THE INVENTION

In one embodiment, the present invention provides a chair comprising: a) a base; b) a frame mounted on the base; c) a seat pivotally mounted to a distal end of the frame; d) a back pivot member pivotally mounted to a proximate end of the frame, the back pivot member having a back support extension and a seat lift extension, wherein the seat lift extension lifts a proximate end of the seat when the back pivot member rotates in a rearward direction; and e) a back support mounted to the back support extension of the back pivot member.

In another embodiment, the present invention provides a chair wherein the frame comprises at least one rear pivot extension.

In one embodiment, the present invention provides a chair wherein the back pivot member further comprises at least one retaining plate, wherein the rear pivot extension is pivotally mounted to the back pivot member by the retaining plate, which brackets an outer edge of the rear pivot extension such that the retaining plate slides along the outer edge of the rear pivot extension as the back pivot member rotates in a rearward direction.

In yet another embodiment, the present invention provides a chair wherein the back pivot member further comprises a slider bracket mounted to the back pivot member underneath the seat lift extension, wherein the rear pivot extension comprises a transverse slot in a rearward direction, such that the rear pivot extension pivotally mounts to the back pivot by the slider bracket positioned within the slot and slides within the transverse slot as the back pivot member rotates in a rearward direction.

In yet another embodiment, the present invention provides a chair wherein the back pivot member further comprises a rod, and wherein rear pivot extension has a through-hole, the rear pivot extension pivotally mounted to the back pivot member by the rod positioned through the through-hole.

In still other embodiments, the present invention provides a chair wherein the rod has a through-bore, and wherein the back pivot member further comprises a washer with diameter greater than the through-hole, the washer positioned outward from the through-hole of the rear pivot extension, a long bolt, and a slot, such that the long bolt may be inserted through the washer, the through-hole of the rear pivot extension, the through-bore of the rod, and engaged with the slot of the back pivot member to pivotally secure the back pivot member to the rear pivot extension of the frame.

In other embodiments, the present invention provides a chair wherein the frame further comprises two rear pivot extensions having coaxial through holes.

In some embodiments, the present invention provides a chair wherein the back pivot member further comprises a rod, the rear pivot extensions pivotally mounted to the back pivot member by the rod positioned through the coaxial through-holes of the rear pivot extensions.

In some embodiments, the present invention provides a chair wherein the seat comprises a pivot clevis mounted to an underside of the seat.

In still other embodiments, the present invention provides a chair wherein the frame further comprises at least one front pivot extension.

In some embodiments, the present invention provides a chair further comprising two front links, wherein the front pivot extension pivotally mounts to the seat by a first pin connecting the two front links to the pivot clevis and by a second pin connecting the two front links to the front pivot extension.

In yet other embodiments, the present invention provides a chair wherein the frame further comprises two front pivot extensions.

In some embodiments, the present invention provides a chair wherein the front pivot extensions pivotally mount to the seat by a pin connecting the pivot clevis to the front pivot extensions.

In some embodiments, the present invention provides a chair wherein the seat comprises a glide plate mounted to the underneath of the seat such that the seat lift extension lifts a proximate end of the seat by engaging the glider plate when the back pivot member rotates in a rearward direction.

In yet other embodiments, the present invention provides a chair wherein the seat lift extension is a glider cam.

In some embodiments, the present invention provides a chair wherein the seat lift extension slidably mounts to a railing mounted to an underside of the seat such that seat lift extension slides toward the proximate end of the seat when the back pivot member rotates in a rearward direction.

In yet other embodiments, the present invention provides a chair wherein the seat lift extension includes a carriage containing ball bearings, the carriage slidably mounted to the railing located on the underside of the seat.

In yet other embodiments, the present invention provides a chair wherein at least one spring engages the seat and the frame.

To the accomplishment of the foregoing and related ends, the present invention comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

V. BRIEF DESCRIPTION OF THE DRAWINGS

In consideration of the following detailed description of various embodiments, the invention may be more completely understood in connection with the following drawings.

FIG. 2(*b*) is a perspective view of one embodiment of a frame of the present invention.

FIG. 2(*c*) is a perspective view of one embodiment of a seat of the present invention.

FIG. 2(*d*) is a perspective view of an alternate embodiment of a back pivot member of the present invention.

FIG. 2(*e*) is a top view of an embodiment of a back pivot member pivotally mounted to a frame of the present invention.

FIG. 5(*b*) is an exploded view of an embodiment of a back pivot member pivotally mounted to a frame of the present invention.

FIG. 7(*b*) is a perspective view of an embodiment of a seat of the present invention.

FIG. 8(*b*) is a side view of an embodiment of the present invention.

FIG. 9(*b*) is a side view of another embodiment of the present invention.

Figure 1:
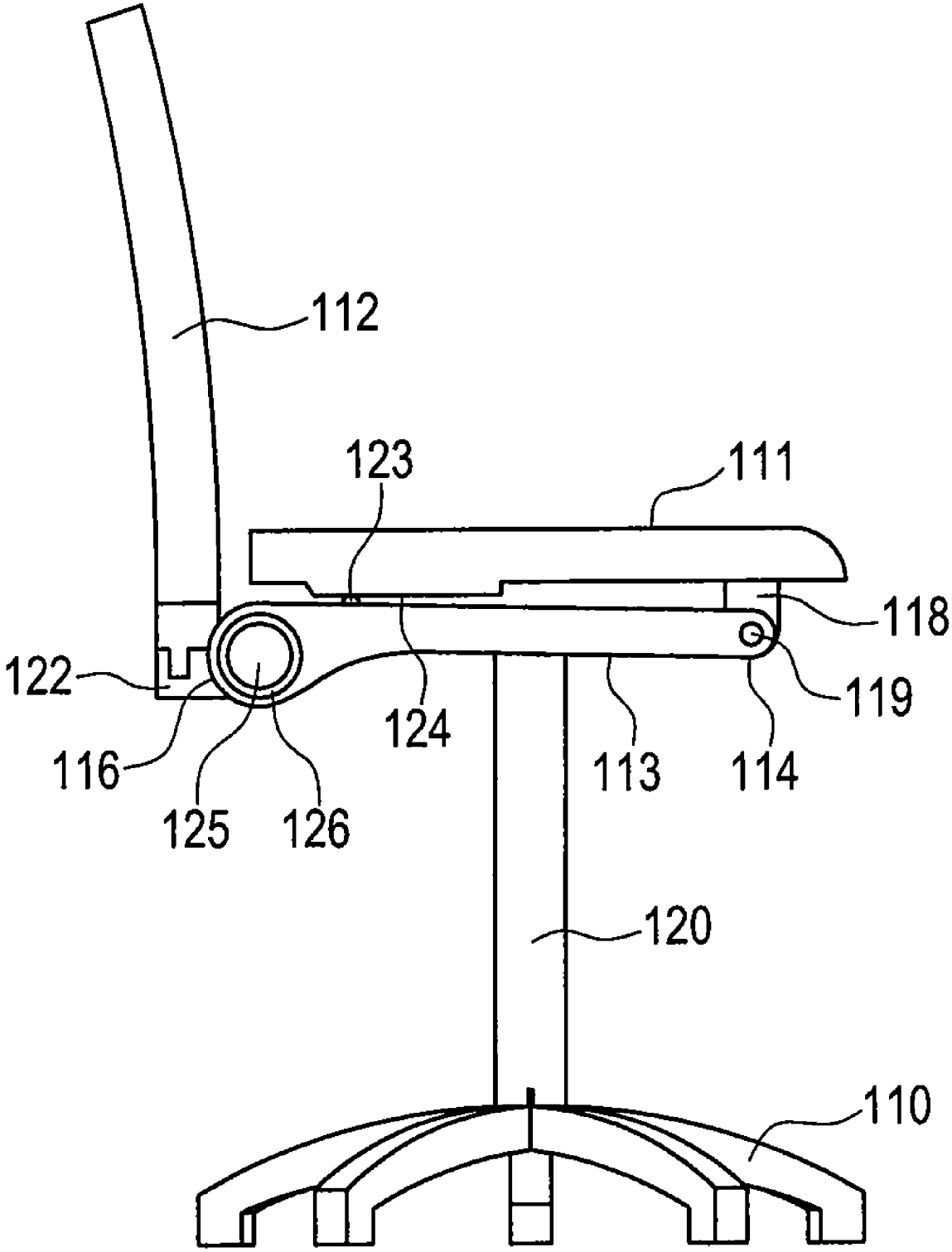
FIG. 1 is a side view of one embodiment of the present invention.
Figure 2A:
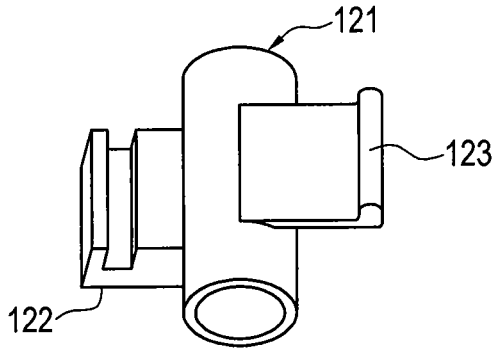
FIG. 2(*a*) is a perspective view of one embodiment of a back pivot member of the present invention.
Figure 2B:
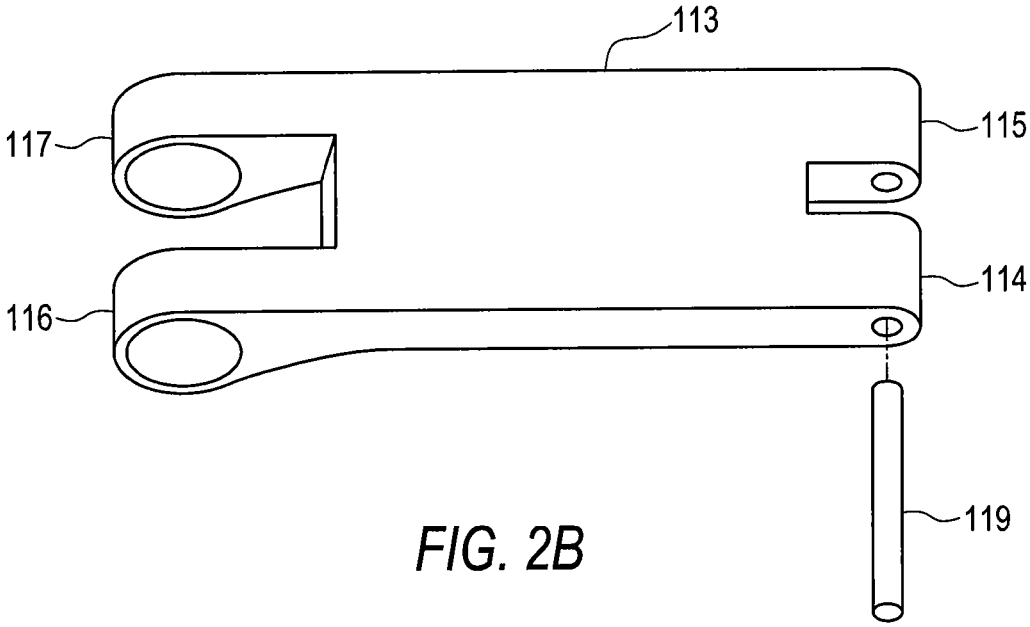
Figure 2C:
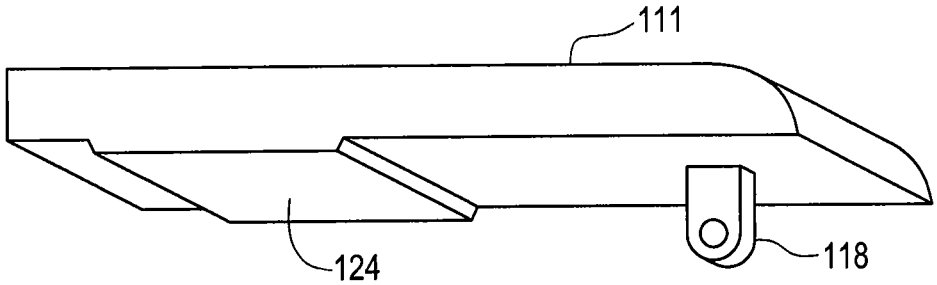
Figure 2D:
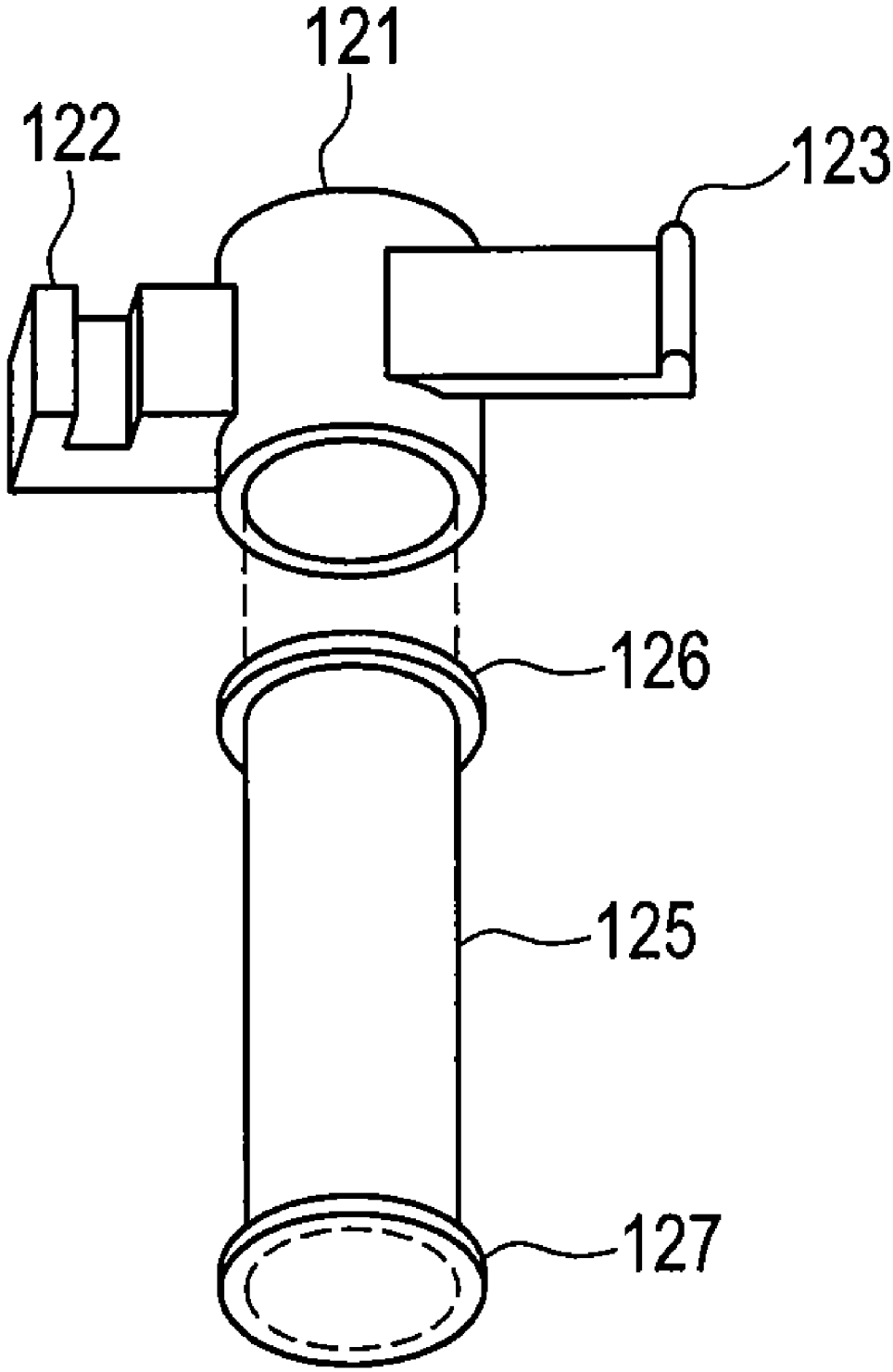
Figure 2E:
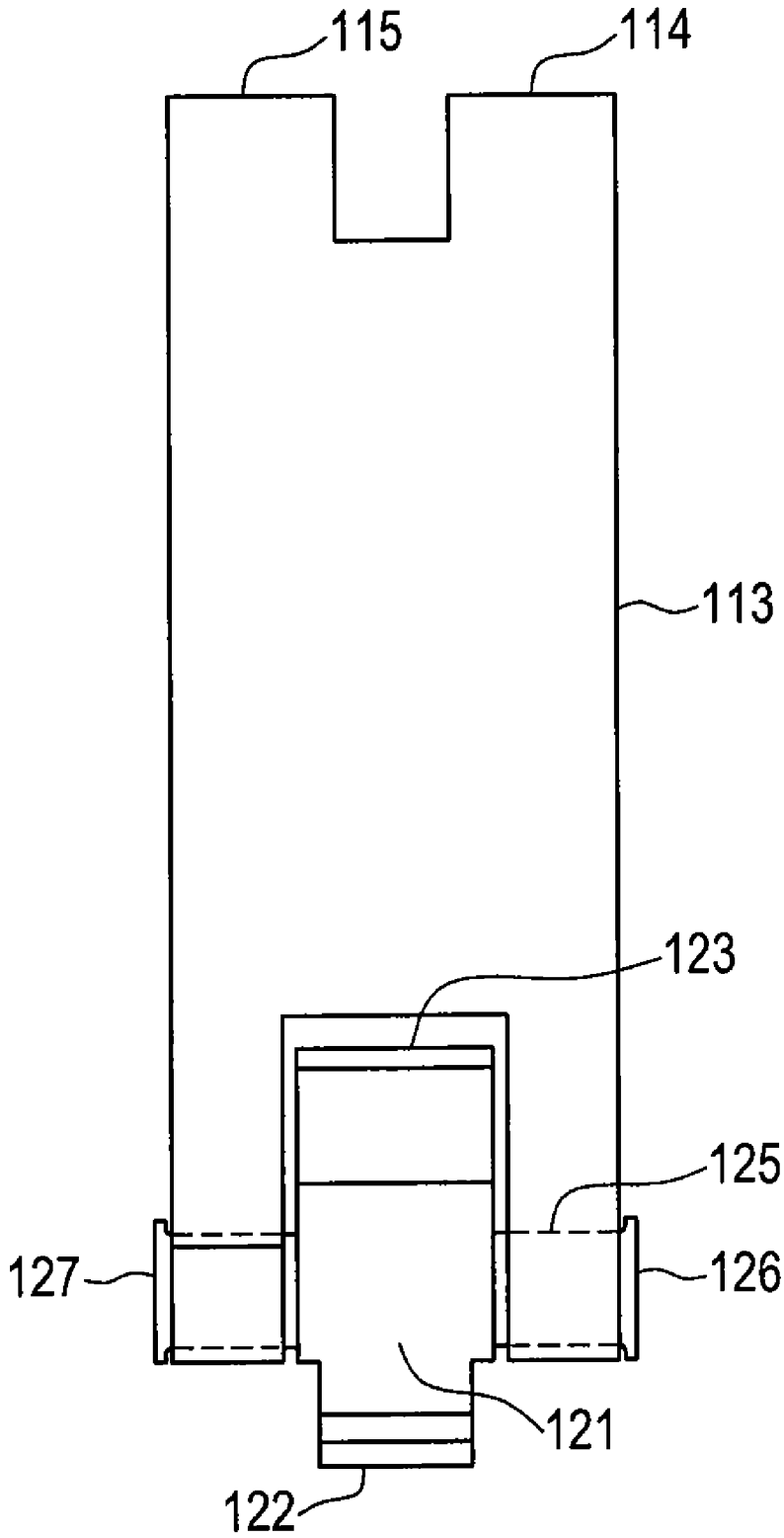

Although the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

VI. DETAILED DESCRIPTION OF THE DISCLOSED EMBODIMENTS

The present invention relates generally to a chair having an automatically adjusting resistance to tilt. As used herein, the term "back support" means any back rest or structure to support the back located on a chair. The term "seat" means any seating cushion, surface or structure to support the weight of an occupant of a chair.

Figure 3:
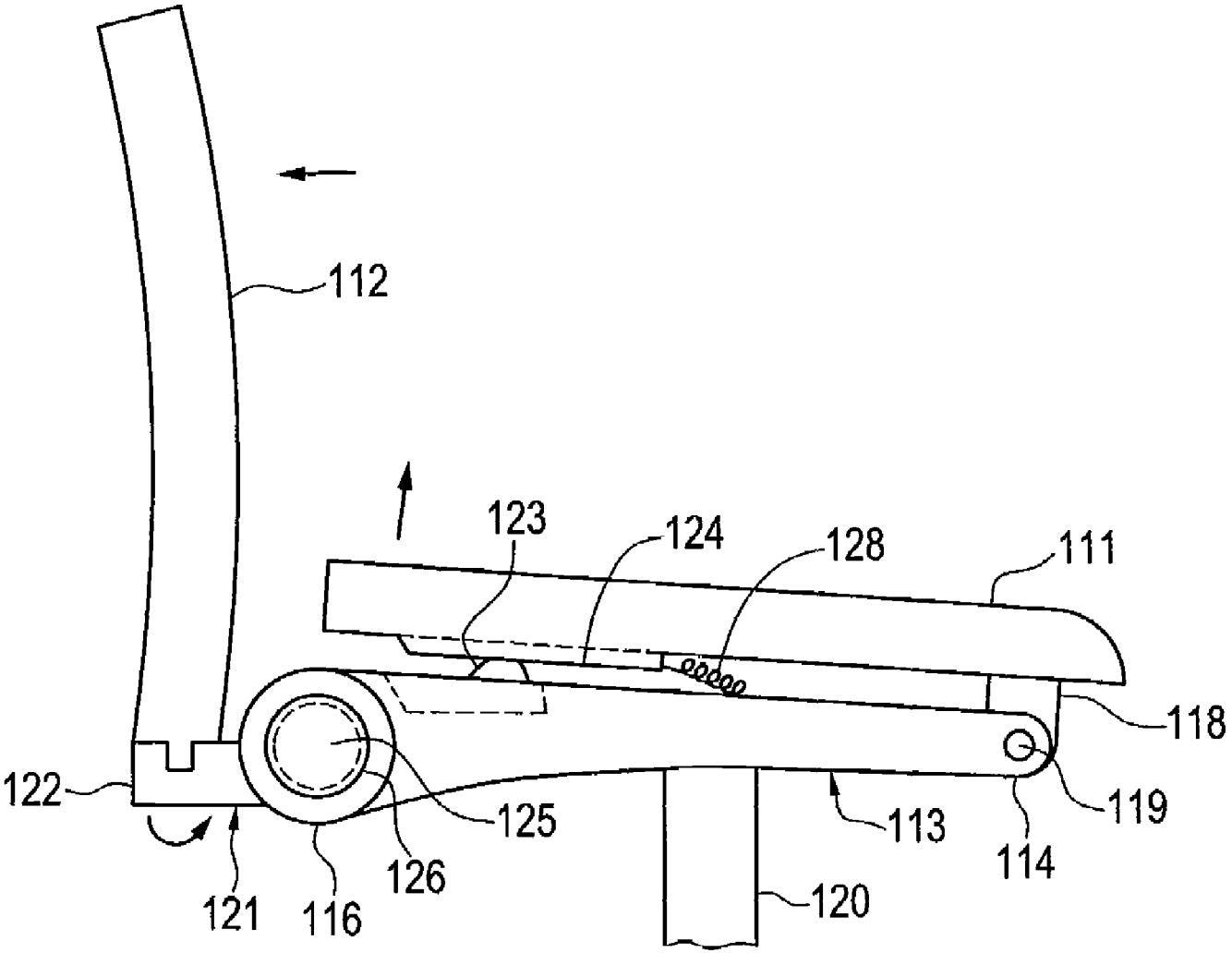
FIG. 3 is a side view of an embodiment of the present invention.

Referring to the embodiment shown in FIGS. 1-3, a chair featuring a reclining back support comprises base 110, seat 111, back pivot member 121, frame 113, and back support 112. Base 110 includes vertical post 120, which projects upward from the center of base 110. Base 110 further includes a plurality of legs, a plurality of legs accommodating casters, or any other base known in the art. Vertical post 120 is preferably cylindrical in shape, and may be hollow or solid. Base 110 rests on the floor to support the chair mounted on the distal end of vertical post 120.

Referring still to the embodiment shown in FIGS. 1-3, the rearward portion of seat 111 is supported by glide plate 124, a flat plate connected to the underside of seat 111 to provide a contact surface for seat lift extension 123 of back pivot member 121. Pivoting clevis 118 extends from the forward portion of seat 111 and pivotally mounts to frame 113 with pin 19 to form a horizontal pivot point for seat 111.

Back pivot member 121 has a back support extension 122 and a seat lift extension 123, and pivotally mounts to frame 113 with back pivot rod 125 to form a horizontal pivot point for back support 112. Seat lift extension 123 extends upward from back pivot member 121 such that its distal end is in contact with glide plate 124. Back support extension 122 extends rearward from back pivot member 121 to receive back support 112 for attachment thereto.

Frame 113 preferably comprises a rectangular frame supporting two pairs of frame extensions. Front pivot extensions 114, 115 are separated by a distance great enough to receive pivoting clevis 118, and pin 119 inserts into bores through front pivot extensions 114, 115 to pivotally mount seat 111 to frame 113. Rear pivot extensions 116, 117 are separated by a distance great enough to receive back pivot member 121, and back pivot rod 125 inserts into through-holes through rear pivot extensions 116, 117 to pivotally mount back pivot member 121 to frame 113. As shown in FIG. 2(*a*), back pivot rod 125 may be an integral part of back pivot member 121, or as shown in FIG. 2(*d*), back pivot rod 125 may be a separate component inserted through back pivot member 121 and frame 113 to pivotally mount back pivot member 121 to frame 113. Also as shown in FIG. 2(*d*), optional flanges 126, 127 on back pivot rod 125 may retain back pivot rod 125 within back pivot member 121 and rear pivot extensions 116, 117.

Referring now to the embodiment shown in FIG. 3, spring 128 may be connected between frame 113 and seat 111. Spring 128 can be used to adjust the amount of force required to recline back support 112. In a similar manner, spring 128 can be used to restore back support 112 to its resting position when the chair is unoccupied.

In operation, an occupant of the chair sitting on seat 111 reclines by exerting a rearward force on back support 112. This rearward force causes back support 112 to move in a rearward direction, which, in turn, causes back pivot member 121 to rotate about back pivot rod 125. The rotation causes seat lift extension 123 to move in an upward direction, which exerts an upward force on glide plate 124. Seat 111 then rotates about pin 119 and the rearward portion of seat 111 moves substantially in the vertical direction to incline seat 111. It is preferred that the inclining of seat 111 to counteract the reclining of back support 112 raises seat 111 between about 0.2 and 2 inches from a substantially horizontal resting position. It is further preferred that the inclining of seat 111 raises seat 111 between about 0.4 and 1 inch from a substantially horizontal resting position. In a particularly useful embodiment, the inclining of seat 111 raises the forward portion of seat 111 about 0.6 inches, and raises the rearward portion of seat 111 about 0.8 inches.

As is apparent from the above description, the horizontal pivot point for the reclining of back support 112 is not the chair occupant's hip joint. Consequently, the reclining of the back support 112 circumscribes an arc that is displaced from the arc based on the chair occupant's hip joint. However, the concurrent action of the reclining mechanism described herein of raising the rearward portion of seat 111 produces a net positioning of the occupant of the chair that is substantially the same as the positioning which would have been achieved if the center of the arc circumscribed by the reclining of back support 112 recline were coextensive with the arc based upon the chair occupant's hip joint.

Figure 7A:
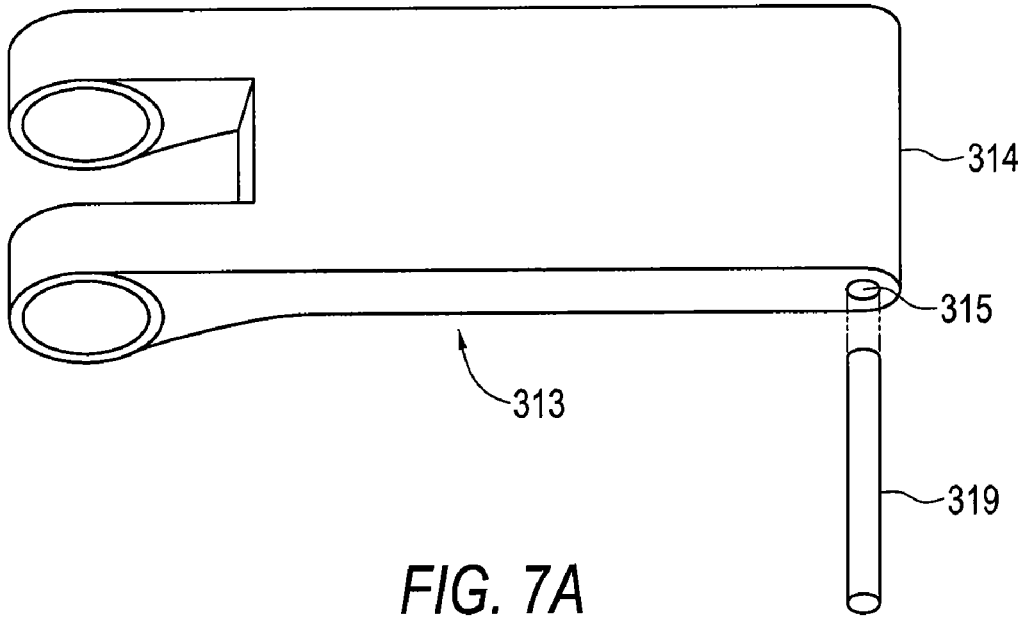
FIG. 7(*a*) is a perspective view of an embodiment of a frame of the present invention.
Figure 7B:
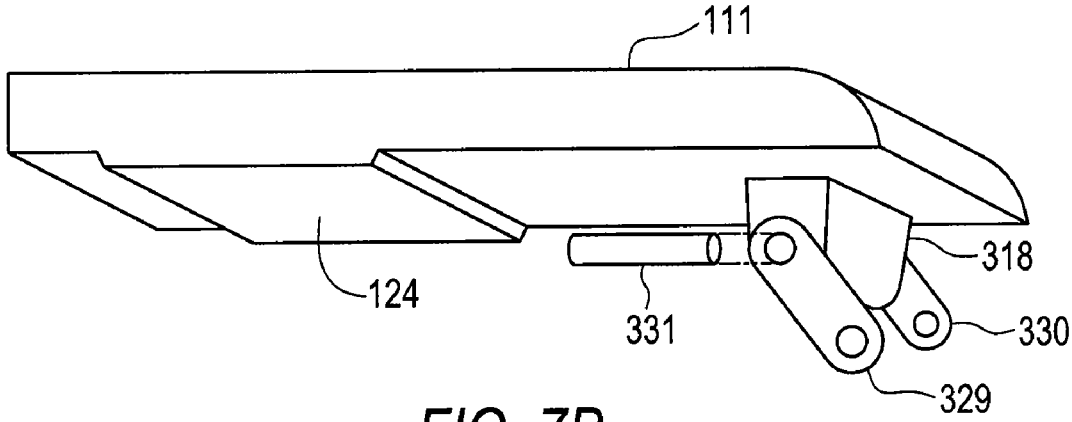

Referring now to alternative embodiments of frame 113 and seat 111 shown in FIGS. 7(*a*) and 7(*b*), frame 313 comprises instead one front pivot extension 314 having a through bore 315. Front pivot extension 314 preferably has a width great enough to accommodate pivoting clevis 318 of seat 111. Pin 319 inserts through bore 315 of front pivot extension 314 to mount frame 313 to front links 329, 330. Pin 331 inserts through pivoting clevis 318 of seat 111 to mount front links 329, 330 to pivoting clevis 318. Pins 319, 331 may be capable of rotating or may be fixed in place. If pins 319, 331 are fixed, links 329, 330 would rotate about the pins 319, 331. Back pivot member 121 may pivotally mount to frame 313 in any manner herein described or known in the art. Likewise, back support 112 may mount to back pivot member 121 and base 110 may mount to frame 313 in any manner herein described or known in the art.

Figure 4:
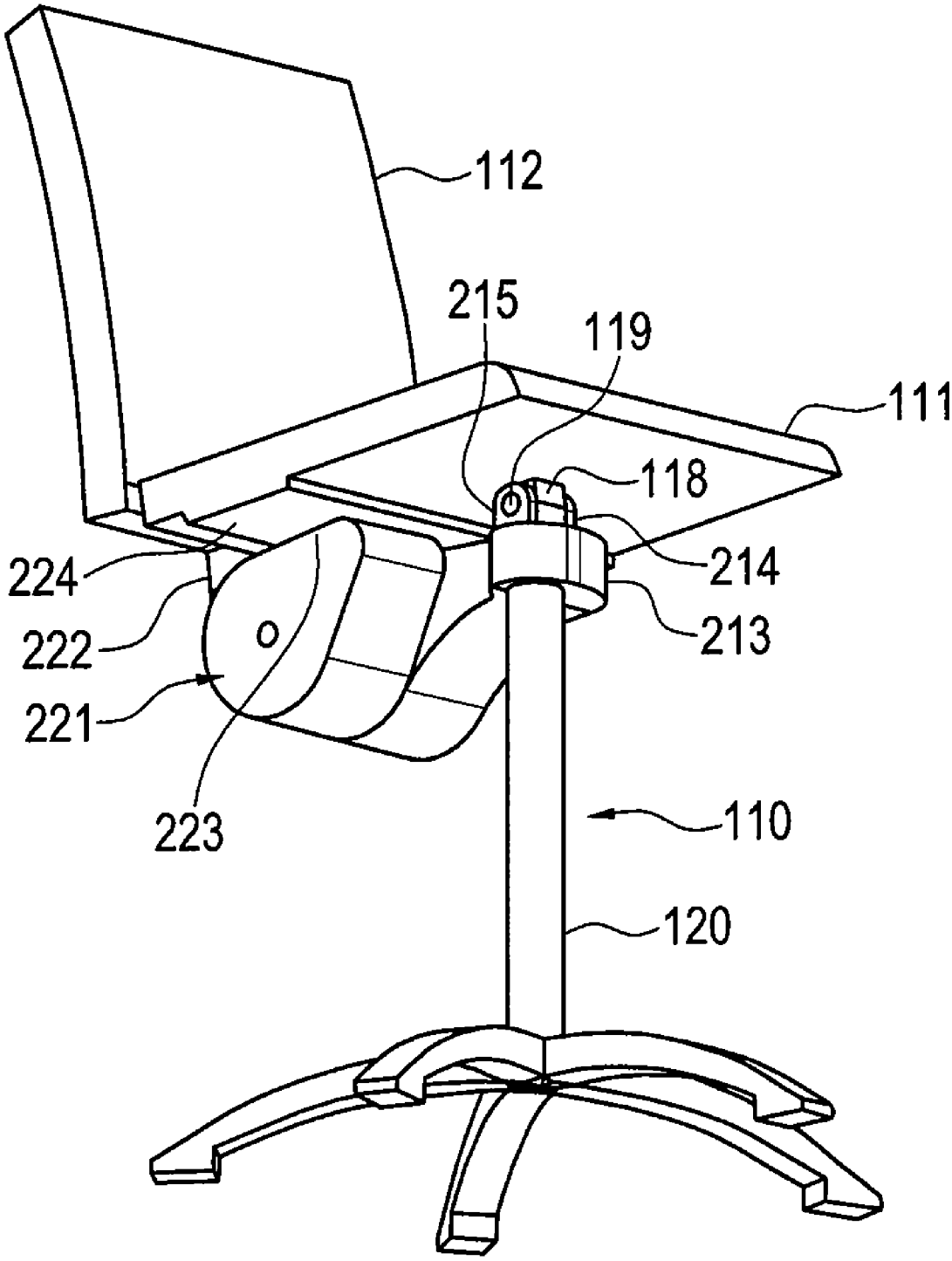
FIG. 4 is a perspective view of another embodiment of the present invention.
Figure 5A:
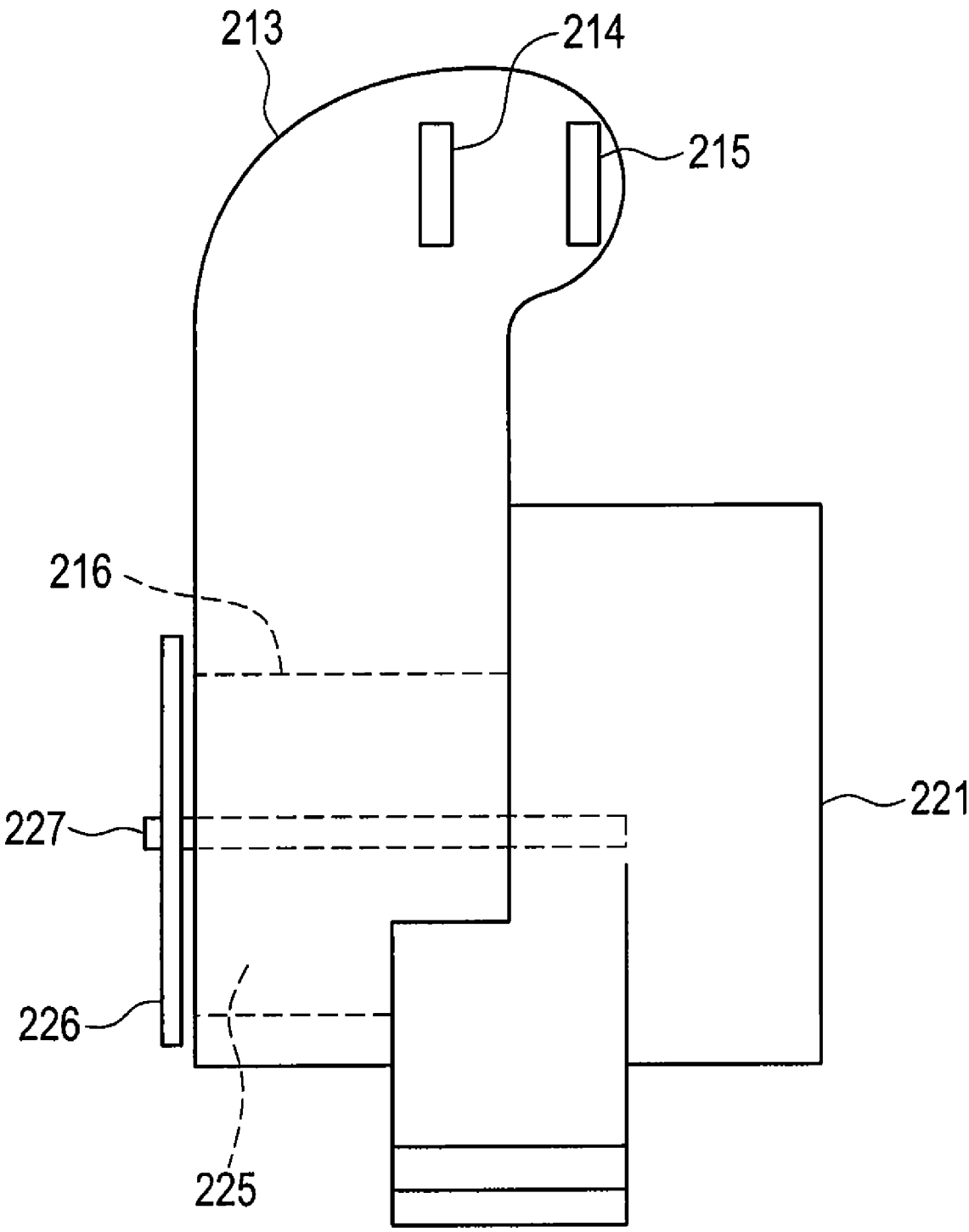
FIG. 5(*a*) is a top view of an embodiment of a back pivot member pivotally mounted to a frame of the present invention.
Figure 5B:
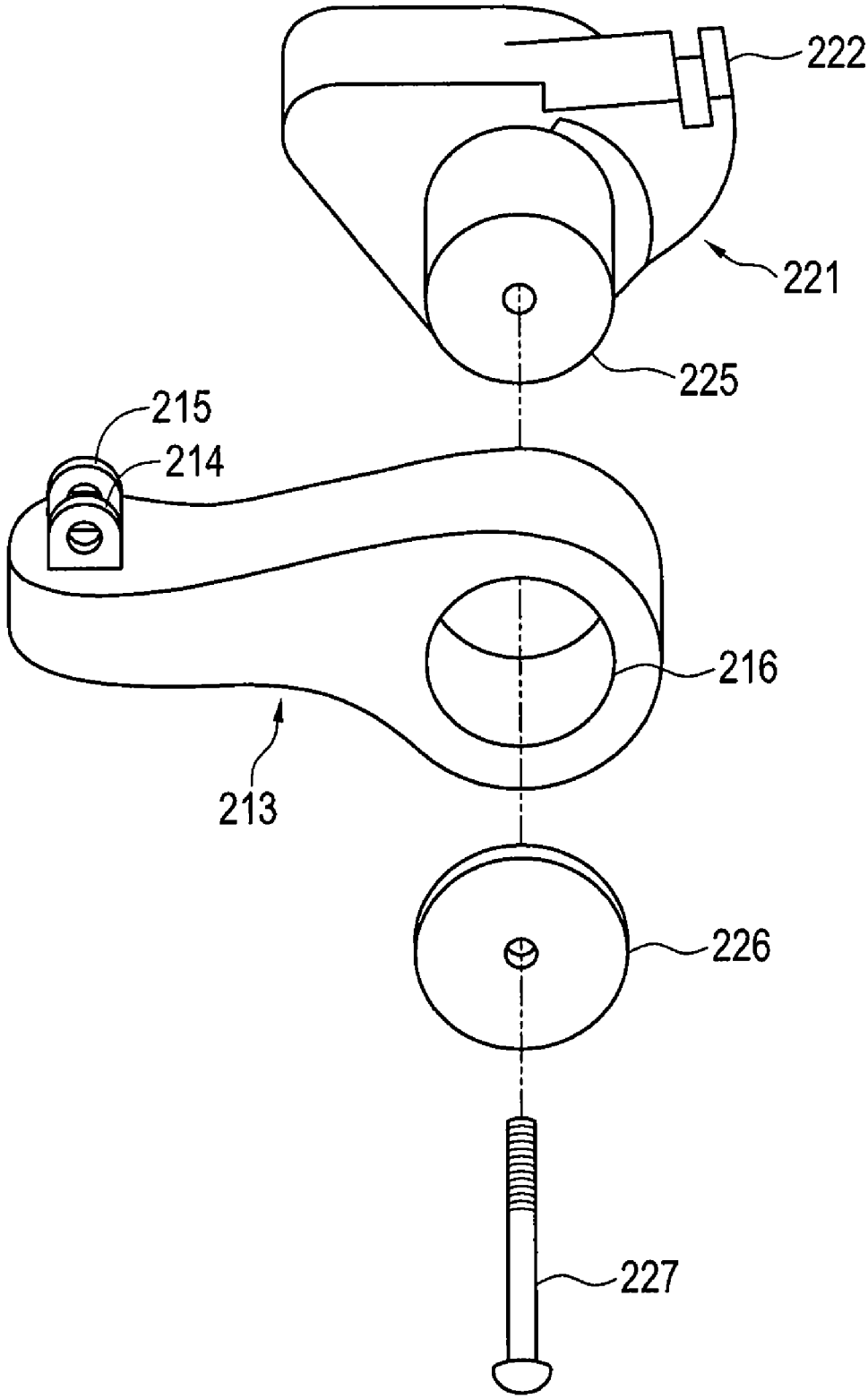
Figure 6:
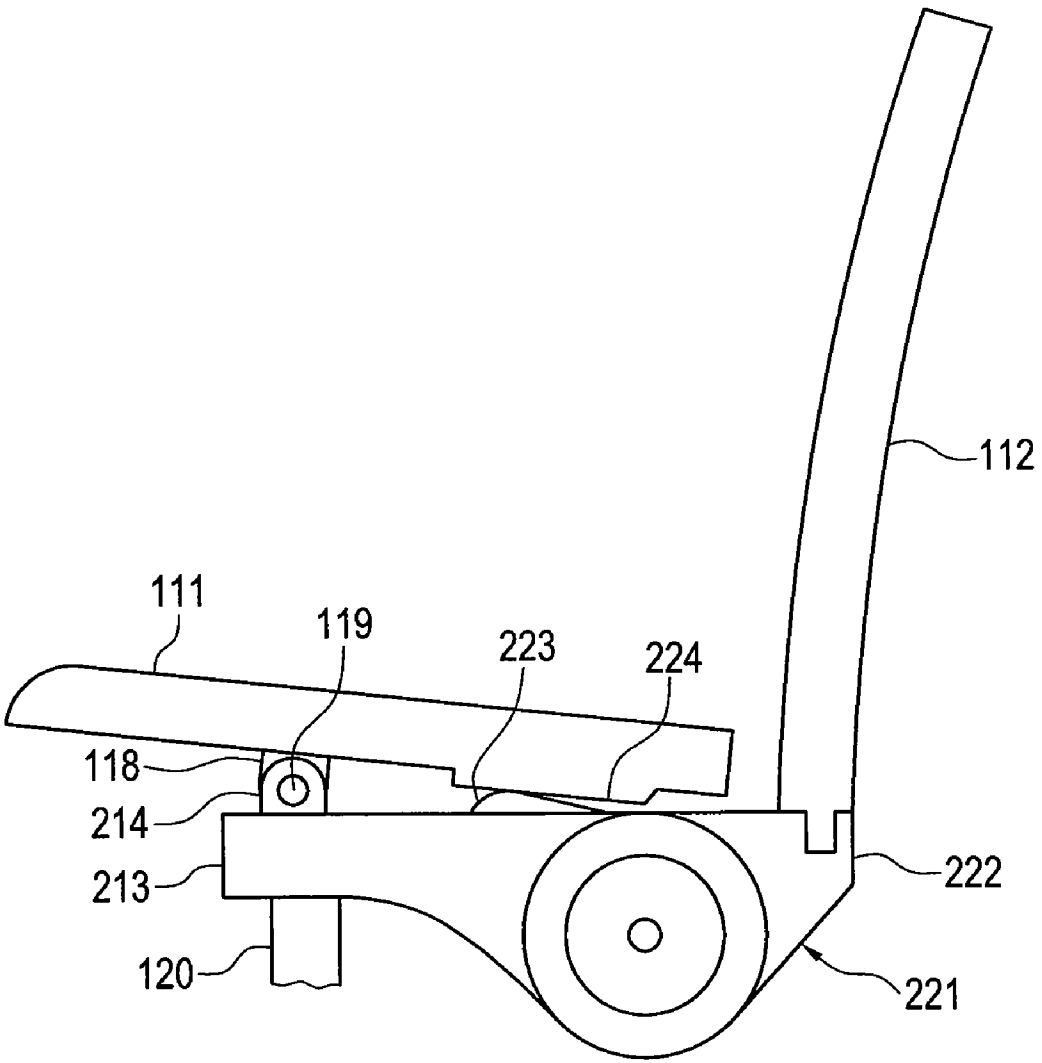
FIG. 6 is a side view of an embodiment of the present invention.

Referring now to the embodiment shown in FIGS. 4-6, a chair featuring a reclining back support comprises base 110, seat 111, back pivot member 221, frame 213, and back support 112. Base 110 and vertical post 120, operate as described herein with respect to other embodiments, and as is known in the art.

Referring still to the embodiment shown in FIGS. 4-6, the rearward portion of seat 111 is supported by glide plate 224, a flat plate connected to the underside of seat 111 which contacts glider cam 223 of back pivot member 221. Pivoting clevis 118 extends from the forward portion of seat 111 and pivotally mounts to frame 213 with pin 119 to form a horizontal pivot point for seat 111.

Back pivot member 221 includes back pivot rod 225, back support extension 222 and glider cam 223, and pivotally mounts to frame 213 with integral back pivot rod 225 to form a horizontal pivot point for back support 112. Glider cam 223 extends upward as back pivot member 221 pivots about back pivot rod 225 such that glider cam 223 contacts glide plate 224. Back support extension 222 extends rearward from back pivot member 221 to receive back support 112 for attachment thereto. Back pivot rod 225 may include a through-bore in order to facilitate pivotally securing back pivot member 221 to frame 213.

Frame 213 preferably comprises a rectangular frame supporting rear pivot extension 216, which may incorporate an integral through-hole, and front pivot extensions 214, 215. Front pivot extensions 214, 215 are separated by a distance great enough to receive pivoting clevis 218, and pin 219 inserts through front pivot extensions 214, 215 to pivotally mount seat 111 to frame 213. Rear pivot extension 216 receives back pivot rod 225 to pivotally mount back pivot member 221 to frame 213. Washer 226 secures back pivot rod 225 within rear pivot extension 216. Washer 226 may be a plate having a circumference greater than the through-hole of rear pivot extension 216, and washer 226 may be secured to a threaded slot (not shown) in back pivot member 221 by long bolt 227.

In operation, an occupant of the chair sitting on seat 111 reclines by exerting a rearward force on back support 112. This rearward force causes back support 112 to move in a rearward direction, which, in turn, causes back pivot member 221 to rotate about back pivot rod 225. The rotation causes glider cam 223 to move in an upward direction, which exerts an upward force on glide plate 124. Seat 111 then rotates about pin 119 and the rearward portion of seat 111 moves substantially in the vertical direction to incline seat 111. It is preferred that the inclining of seat 111 to counteract the reclining of back support 112 raises seat 111 between about 0.2 and 2 inches from a substantially horizontal resting position. It is further preferred that the inclining of seat 111 raises seat 111 between about 0.4 and 1 inch from a substantially horizontal resting position. In a particularly useful embodiment, the inclining of seat 111 raises the forward portion of seat 111 about 0.6 inches, and raises the rearward portion of seat 111 about 0.8 inches.

As is apparent from the above description, the horizontal pivot point for the reclining of back support 112 is not the chair occupant's hip joint. Consequently, the reclining of the back support 112 circumscribes an arc that is displaced from the arc based on the chair occupant's hip joint. However, the concurrent action of the reclining mechanism described herein of raising seat 111 produces a net positioning of the occupant of the chair that is substantially the same as the positioning which would have been achieved if the center of the arc circumscribed by the reclining of back support 112 recline were coextensive with the arc based on the chair occupant's hip joint.

Figure 8A:
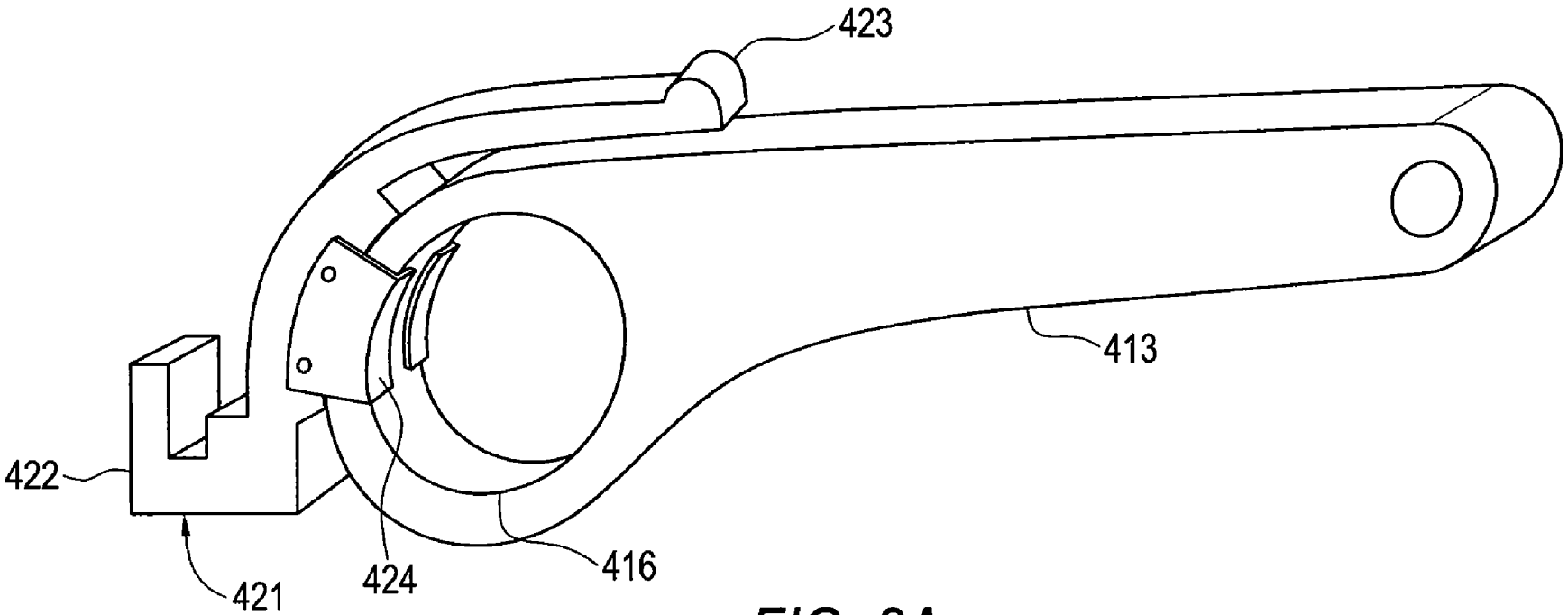
FIG. 8(*a*) is a perspective view of an embodiment of a back pivot member pivotally mounted to a frame of the present invention.
Figure 8B:
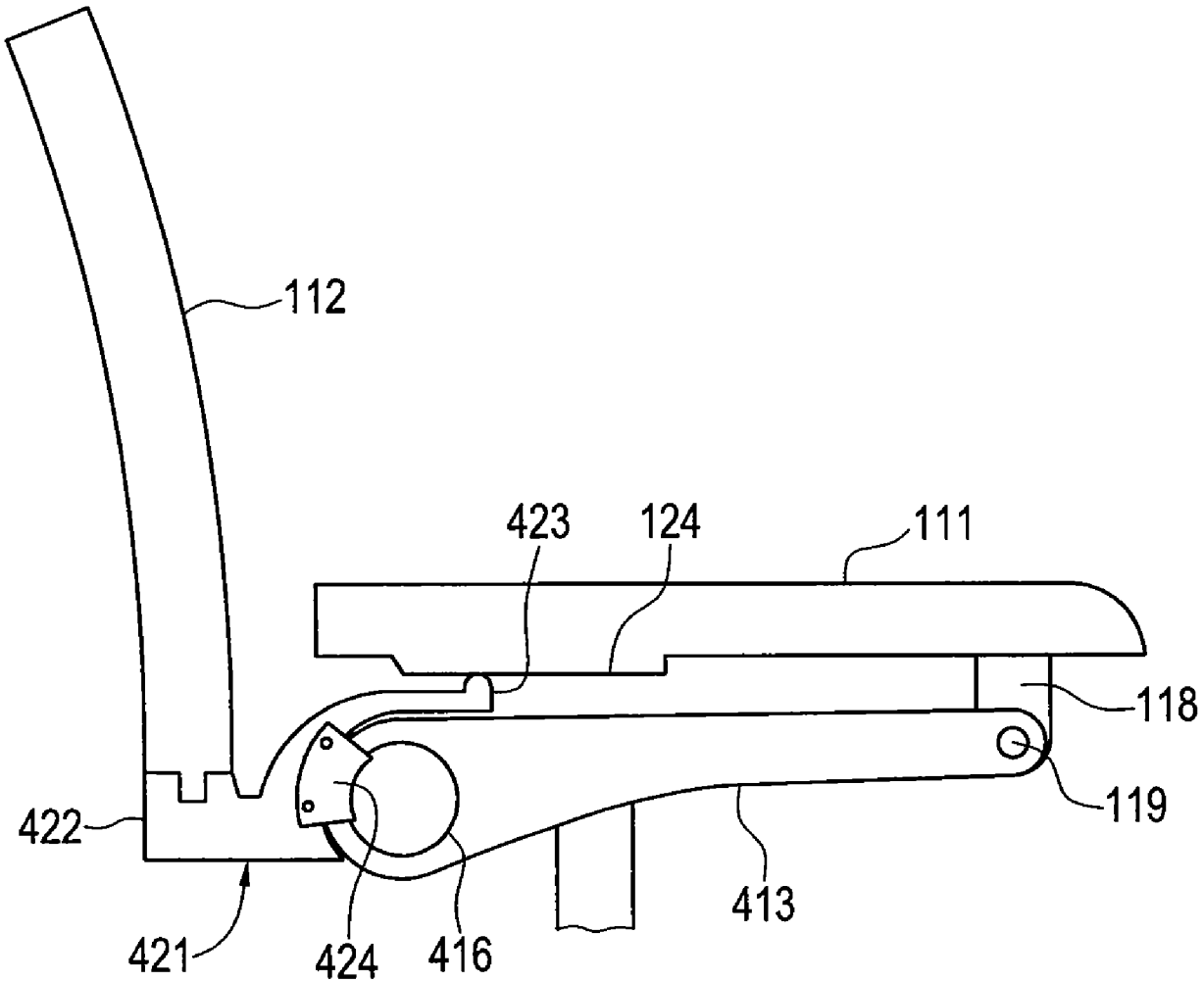

Referring now to an alternative embodiment shown in FIGS. 8(*a*) and 8(*b*), back pivot member 421 includes back support extension 422, one or more retaining plates 424, and seat lift extension 423. Retaining plate 424 may be an "L" shaped bracket, any type of bracket known in the art could be used, attached to back pivot member 421 and positioned to slide along the inside wall of rear pivot extension 416 such that back pivot member 421 pivotally mounts to frame 413 to form a horizontal pivot point for back support 112. Seat lift extension 423 extends upward as back pivot member 421 pivots about frame 413 such that seat lift extension 423 contacts glide plate 124. Back support extension 422 extends rearward from back pivot member 421 to receive back support 112 for attachment thereto.

Referring still to FIGS. 8(*a*) and 8(*b*), frame 413 preferably comprises a rectangular frame supporting rear pivot extension 416, which is an integral through-hole, and pivotally mounts to seat 111 in any manner described herein or known in the art. Rear pivot extension 416 receives retaining plate 424 to pivotally mount back pivot member 421 to frame 413.

Figure 9A:
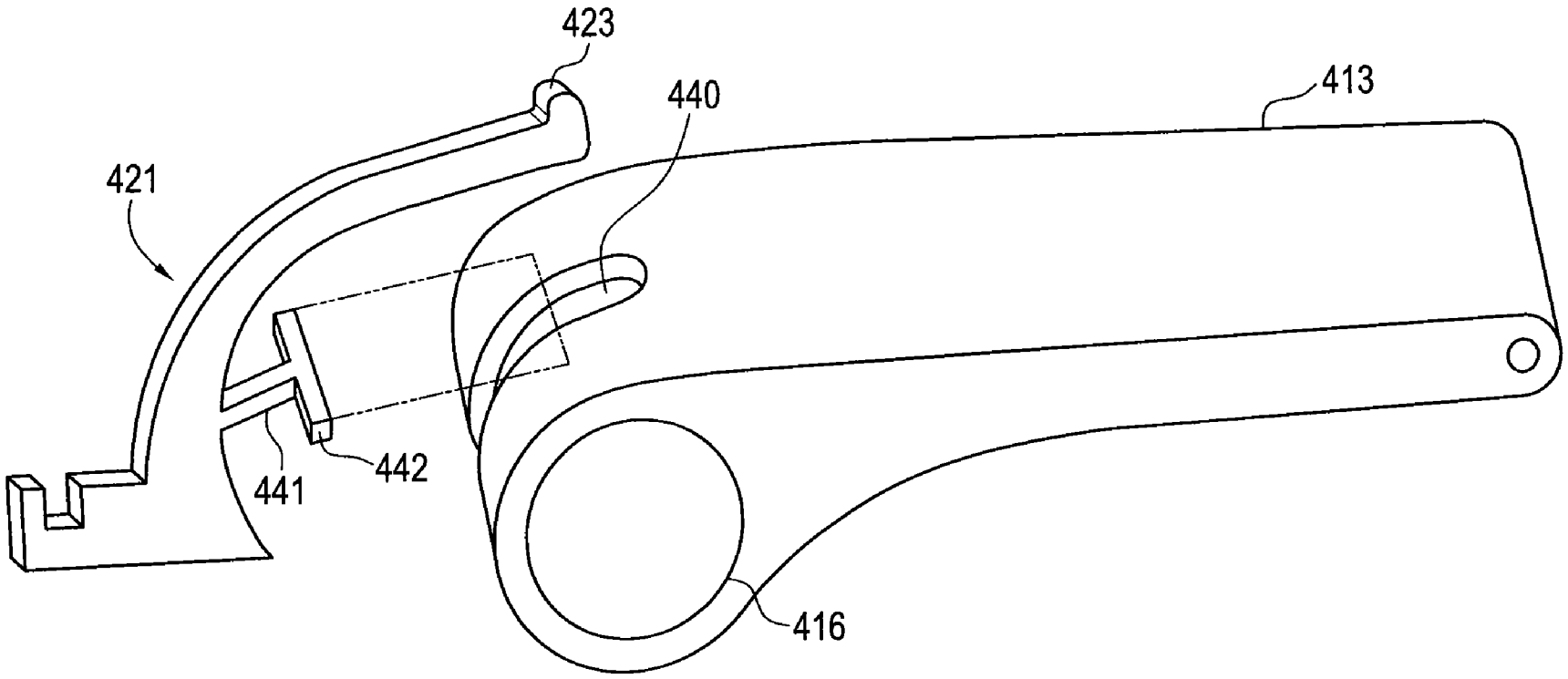
FIG. 9(*a*) is a perspective view of another embodiment of a back pivot member pivotally mounted to a frame of the present invention.
Figure 9B:
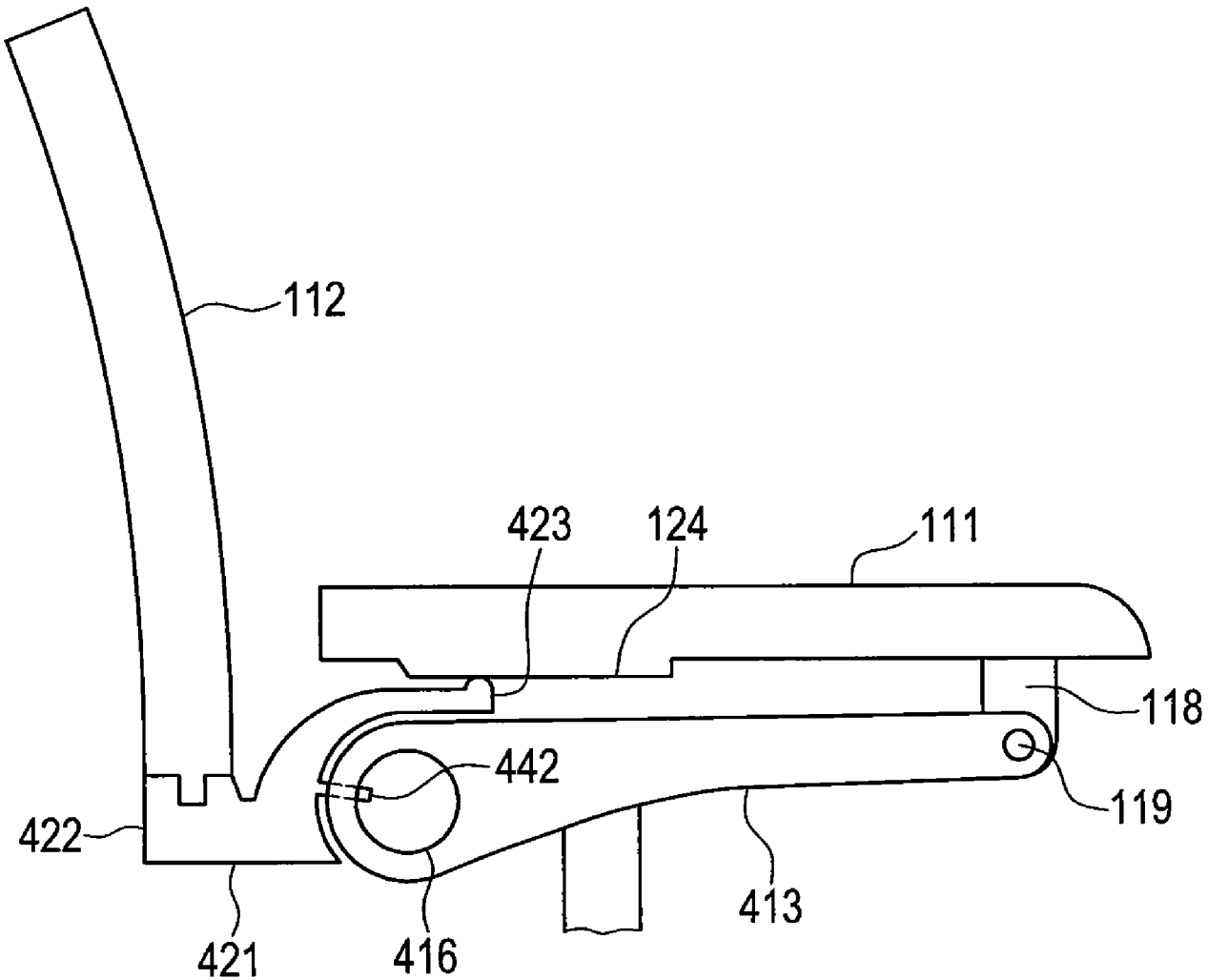

Alternatively, as shown in the embodiment in FIGS. 9(*a*) and 9(*b*), back pivot member 421 may have a central slot 440 through which slider post 441 extends into the cavity defined by rear pivot extension 416. Slot 440 runs longitudinally along the centerline of rear seat extension 416, in the direction of the rotation of back pivot member 421. Sliding bracket 442 is mounted onto slider post 441. Sliding bracket 442 is positioned within the cavity defined by rear seat extension 416 such that the rear wall of frame 413 is interposed between back pivot member 421 and sliding bracket 442, and sliding bracket 441 may slide within slot 440 to pivotally mount back pivot member 421 to frame 413.

In operation, an occupant of the chair sitting on seat 111 reclines by exerting a rearward force on back support 112. This rearward force causes back support 112 to move in a rearward direction, which, in turn, causes back pivot member 421 to rotate about rear seat extension 416. The rotation causes seat lift extension 423 to move in an upward direction, which exerts an upward force on glide plate 124. Seat 111 then rotates about pin 119 and the rearward portion of seat 111 moves substantially in the vertical direction to incline seat 111. It is preferred that the inclining of seat 111 to counteract the reclining of back support 112 raises seat 111 between about 0.2 and 2 inches from a substantially horizontal resting position. It is further preferred that the inclining of seat 111 raises seat 111 between about 0.4 and 1 inch from a substantially horizontal resting position. In a particularly useful embodiment, the inclining of seat 111 raises the forward portion of seat 111 about 0.6 inches, and raises the rearward portion of seat 111 about 0.8 inches.

In yet another alternative embodiment (not shown), seat lift extension 423 may be slidably connected to the underside of seat 111. The slidable connection could be accomplished by using a rail and a ball bearing connection or any means known in the art. The rearward force would cause back support 112 to move in a rearward direction, which, in turn, would cause back pivot member 421 to rotate about rear seat extension 416 of frame 413. The rotation would cause seat lift extension 423 to slide rearward, which exerts an upward force on seat 111. As seat lift extension 423 slides rearward, seat 111 then rotates about pin 119 and the rearward portion of seat 111 moves substantially in the vertical direction to incline seat 111. As would be readily envisioned by one of skill in the art, the various mechanisms described herein are particularly useful in combination for providing functional and attractive chairs. All combinations of the multiple mechanisms described herein are therefore encompassed by the present invention.

Preferentially, unless otherwise indicated, the various components of the present invention are constructed generally out of a strong, lightweight material, such as aluminum. Various different materials could also be used, such as other metals or plastics.

Many modifications and other embodiments of the inventions set forth herein will come to mind to one skilled in the art to which these inventions pertain having the benefit of the teaching presented in the foregoing descriptions and the associated drawings. For instance, as is well known in the art, base 110 may be mounted on vertical post 120 via a piston, such as a conventional gas cylinder and connected operating lever for raising or lowering the height of the chair. It is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A chair comprising:

a) a base;

b) a frame mounted on the base, the frame having at least one rear pivot extension, wherein the rear pivot extension has a through-hole;

c) a seat pivotally mounted to a distal end of the frame;

d) a back pivot member pivotally mounted to a proximate end of the frame, the back pivot member having a back support extension, a seat lift extension, and a rod, wherein the seat lift extension lifts a proximate end of the seat when the back pivot member rotates in a rearward direction, wherein the rear pivot extension is pivotally mounted to the back pivot member by the rod positioned through the through-hole, wherein the rod has a through-bore, and wherein the back pivot member further comprises a washer with diameter greater than the through-hole, the washer positioned outward from the through-hole of the rear pivot extension, a long bolt, and a slot, such that the long bolt may be inserted through the washer, the through-hole of the rear pivot extension, the through-bore of the rod, and engaged with the slot of the back pivot member to pivotally secure the back pivot member to the rear pivot extension of the frame; and e) a back support mounted to the back support extension of the back pivot member.

2. A chair comprising:

a) a base;

b) a frame mounted on the base;

c) a seat pivotally mounted to a distal end of the frame;

d) a back pivot member pivotally mounted to a proximate end of the frame, the back pivot member having a back support extension and a seat lift extension, wherein the seat lift extension lifts a proximate end of the seat when the back pivot member rotates in a rearward direction;

e) a back support mounted to the back support extension of the back pivot member; and f) wherein the seat comprises a glide plate mounted to the underneath of the seat such that the seat lift extension lifts a proximate end of the seat by engaging the glide plate when the back pivot member rotates in a rearward direction.

3. The chair of claim 2 wherein the seat lift extension is a glider cam.

4. A chair comprising:

a) a base;

b) a frame mounted on the base;

c) a seat pivotally mounted to a distal end of the frame, d) a back pivot member pivotally mounted to a proximate end of the frame, the back pivot member having a back support extension and a seat lift extension, wherein the seat lift extension lifts a proximate end of the seat when the back pivot member rotates in a rearward direction, wherein the seat lift extension slidably mounts to a railing mounted to an underside of the seat such that the seat lift extension slides toward the proximate end of the seat when the back pivot member rotates in a rearward direction; and e) a back support mounted to the back support extension of the back pivot member.

5. The chair of claim 4 wherein the seat lift extension includes a carriage containing ball bearings, the carriage slidably mounted to the railing located on the underside of the seat.

* * * * *